United States Patent [19]

Serrano

[11] 4,418,885

[45] Dec. 6, 1983

[54] NOZZLE HOOD FOR MOULDING PIPES

[76] Inventor: Angel B. Serrano, c/o Encomienda de Placios No. 183, Madrid, Spain

[21] Appl. No.: 324,596

[22] Filed: Nov. 24, 1981

[30] Foreign Application Priority Data

Nov. 24, 1980 [ES] Spain ..... 254.608

[51] Int. Cl.[3] ..... B28B 21/04

[52] U.S. Cl. ..... 249/100; 249/144; 425/DIG. 218

[58] Field of Search ..... 249/117, 144, 175, 184, 249/100; 425/DIG. 218

[56] References Cited

U.S. PATENT DOCUMENTS 4,123,033 10/1978 Joelson ..... 249/144

*Primary Examiner*—Thomas P. Pavelko

*Attorney, Agent, or Firm*—Darby & Darby

[57] ABSTRACT

A improved apparatus for molding pipes is dislosed. A hood of convex shape having an outer surface corresponding to the shape of the interior of the pipe and has an annular rim on the widest part thereof and a molding shank rigidly attached to the narrowest part of the hood. A flat annular washer is support on the rim and being separable therefrom to provide a flat terminal end for the molded pipe.

2 Claims, 3 Drawing Figures

NOZZLE HOOD FOR MOULDING PIPES

The present Patent refers to a nozzle hood which greatly simplifies the manufacture of moulded piping and which hood includes a convex volumetric element which on the other hand makes the socket nozzle of each tube and which, in the solution described, includes two parts, one with the apparent shape to mould the inlet of that which precedes it in assembly, and the other as some washers which can be fitted into the previous part and which serves as the basis for the filling and extraction of the tube, once moulded.

Until now, the moulds used comprised a single part which had to be encased in the mould until the pipe was fully hardened and set and, later, had to be knocked out, which was very time-consuming and increased the proportion of breakages to uneconomic limits. For this reason, the solution now proposed was designed, which avoids maintaining a large proportion of capital immobilized, by being able to recover the hood or mouth mould practically once the tube is moulded, and which may be used many times in the same working day, by assisting removal of the dies which only remain reduced to the washers or second part which has no recesses, and whose start is very simple, by having an outlet in a smooth plane, as well as the double vibration contact providing greater advantage being taken, increasing the compactation of the concrete. Also, by having to handle and remove only the washers, very light-weight elements are handled which can be available on site, it being possible to utilize those used until now without any difficulty whatever.

In order to understand the scope of the present solution we are going to describe it on the attached drawings in which a preferred embodiment thereof has been materialized, given by way of example and without a limiting nature.

Figure 1:
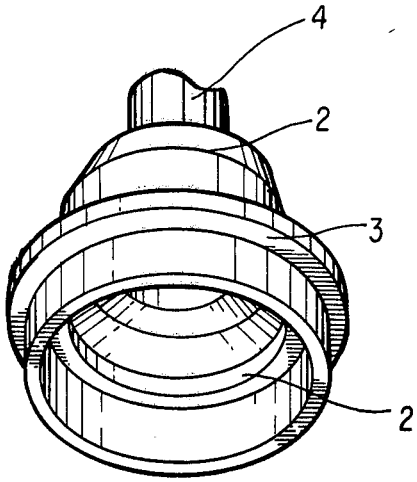
FIG. 1 shows a perspective view of a pipe hood or inlet with the two parts included and ready for moulding.
Figure 2:
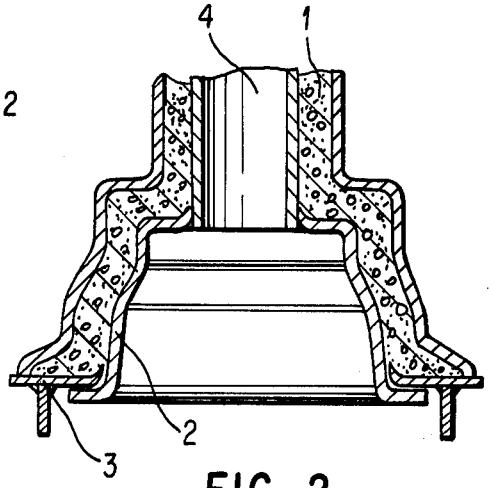
FIG. 2 shows a vertical cross-section of a mould according to the invention.
Figure 3:
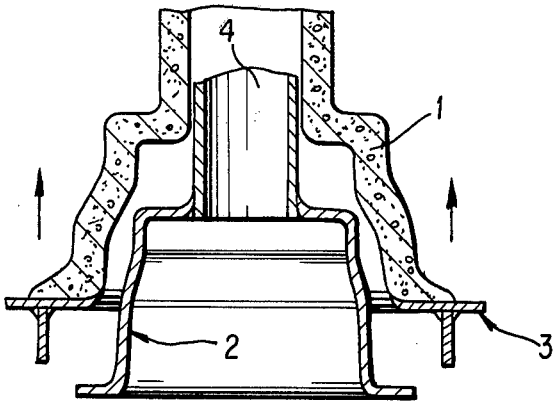
FIG. 3 shows a vertical cross-section of demoulding of the inlet in moulding.

In the drawings we can see that 1 represents the pipe moulded in settable material and whose socket noccle is made by the supported coupling of the hood 2 linked to the moulding shank 4 and to which it is adapted, inside and perimetrically, with a support washer 3 so that placed in this way, it forms the support of the final lips of the nozzle and which on being unmoulded will form the support edge of the pipe without there being any strains or breakages, although the hood 2 has been removed in the favourable direction outwards from the nozzle in the least possible hardening time, and which can be used in another moulding without hampering the installation.

I claim:

1. Apparatus for moulding pipes having a flared nozzle comprising:

a hood of generally convex shape having an outer surface corresponding to the shape of the interior of a pipe to be moulded, said hood including an annular rim on the periphery of the widest part thereof;

a moulding shank rigidly attached to the narrowest part of said hood and extending within the hollow interior of said pipe; and a flat annular washer supported on said annular rim and separable therefrom said hood being removable from said moulded pipe said washer remaining to form a flat terminal end for said pipe.

2. Apparatus as in claim 1 wherein said washer includes a portion which extends generally transverse to the outer face of said flat portion.

* * * * *